US005564624A

United States Patent [19]

Davis, Jr.

[11] Patent Number: 5,564,624

[45] Date of Patent: Oct. 15, 1996

[54] MULTIPLE RECEPTACLE MAIL ORGANIZING SYSTEM

[76] Inventor: Amos Davis, Jr., P.O. Box 502, Cleveland, Miss. 38732

[21] Appl. No.: 432,458

[22] Filed: May 1, 1995

[51] Int. Cl.[6] ..... B65D 91/00

[52] U.S. Cl. ..... 232/24; 232/17; 312/100; 312/211

[58] Field of Search ..... 232/17, 24, 25, 232/26, 33, 38, 39, 45; 312/348.4, 330.1, 211, 212, 324, 326, 100

[56] References Cited

U.S. PATENT DOCUMENTS

| | | | |
|---|---|---|---|
| 175,215 | 3/1876 | Walter | 232/17 |
| 693,770 | 2/1902 | Wright | 232/17 |
| 753,302 | 3/1904 | Ogle | 232/24 |
| 1,094,397 | 4/1914 | Abbath | 312/330.1 |
| 1,817,191 | 8/1931 | Harmony | 232/24 |
| 2,563,094 | 8/1951 | Becker | 232/24 |
| 2,945,621 | 7/1960 | Kopprasch | 232/24 |
| 3,099,389 | 7/1963 | Vadnai | 232/24 |
| 4,121,758 | 10/1978 | Bonner | 232/24 |
| 5,407,127 | 4/1995 | Worden | 232/24 |

*Primary Examiner*—Flemming Saether

[57] ABSTRACT

A mail organizer including a cabinet having a bottom wall, a pair of opposed side walls coupled to and extended upwards from the bottom wall, a curved top wall integral with an upper extent of each side wall, and a back wall connected between the side walls, the top wall, and the bottom wall to define a hollow compartment; a sequential arrangement of mail bins disposed within a central extent of the compartment and secured to the cabinet and with each bin used for holding a selected individual's mail; and a first drawer, a second drawer, and a third drawer positioned in a stacked arrangement that fills an upper portion of the compartment above the mail bins, and a fourth drawer and a fifth drawer positioned in a stacked arrangement that fills a lower portion of the compartment below the mail bins, each drawer further having a slot formed thereon sized to allow deposition of mail and papers within the associated drawer.

1 Claim, 4 Drawing Sheets

FIG 2
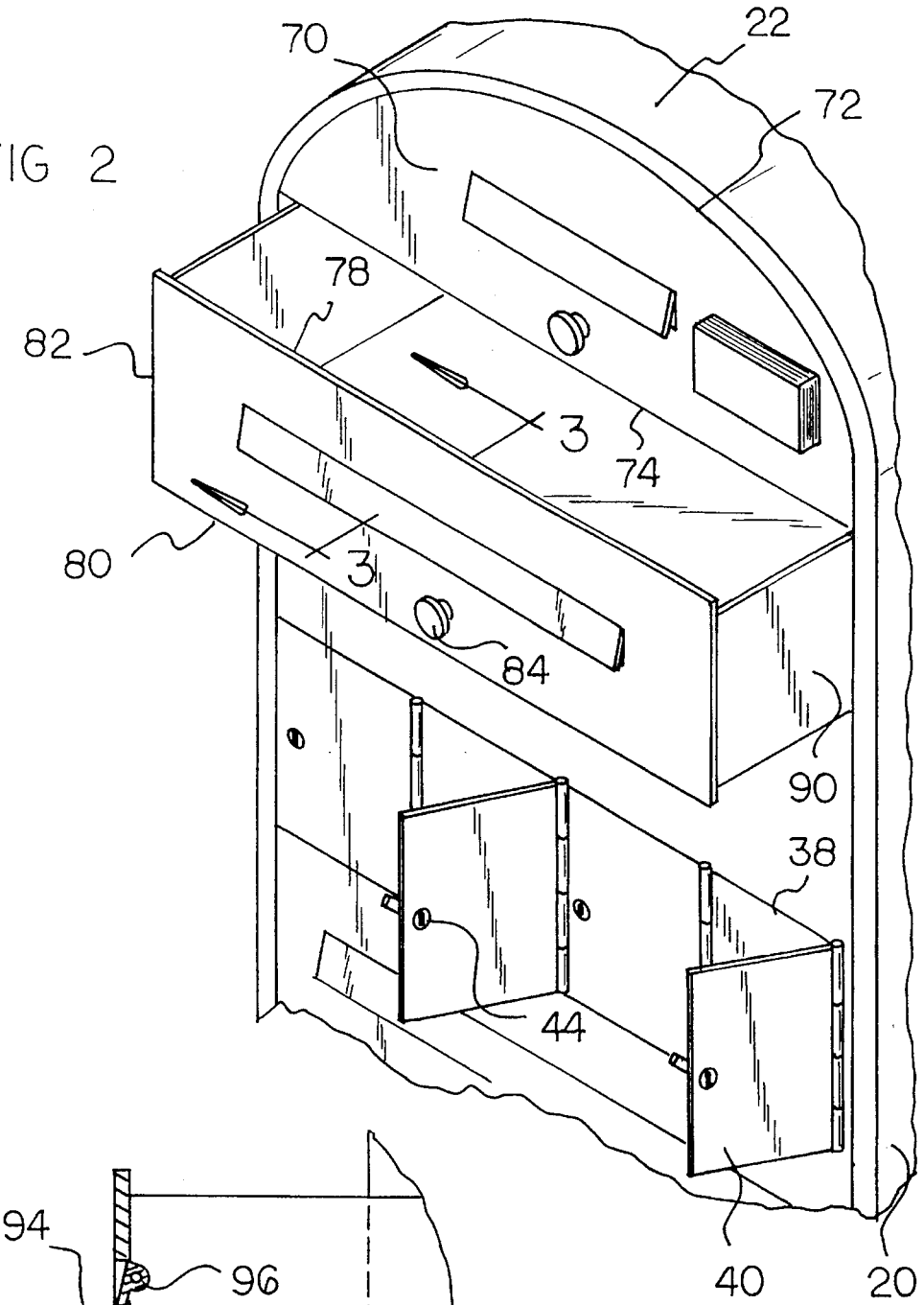
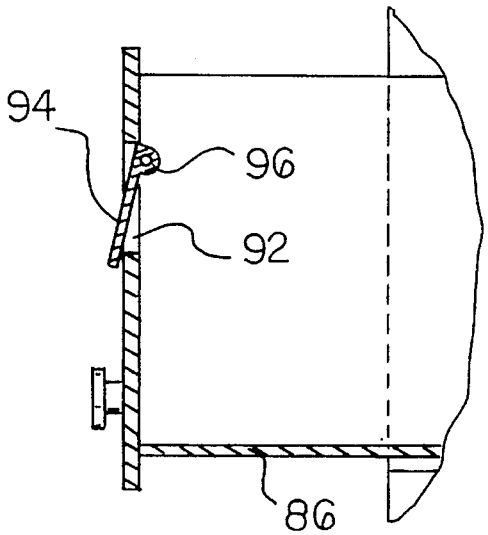
FIG 3

MULTIPLE RECEPTACLE MAIL ORGANIZING SYSTEM

BACKGROUND OF THE INVENTION

1.Field of the Invention

The present invention relates to a mail organizer and more particularly pertains to organizing mail and assorted papers with a mail organizer.

2.Description of the Prior Art

The use of mail organizing devices is known in the prior art. More specifically, mail organizing devices heretofore devised and utilized for the purpose of organizing mail and papers are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 277,624 to Stevens et al. discloses a mail extracting and sorting desk. U.S. Pat. No. 4,419,837 to Meeker discloses an apparatus for displaying advertising material. U.S. Pat. No. 4,571,867 to Williams discloses an information organizing device. U.S. Pat. No. 4,803,795 to Questel et al. discloses a home organizer. U.S. Pat. No. 5,097,961 to Patino et al. discloses an organizer and reminder device for paying bills.

While these devices fulfill their respective, particular objective and requirements, the aforementioned patents do not describe a mail organizer that allows mail of a family or other group of individuals to be organized in one central location.

In this respect, the mail organizer according to the present invention substantially departs from the conventional concepts and designs of the prior art, and in doing so provides an apparatus primarily developed for the purpose of organizing mail and assorted papers.

Therefore, it can be appreciated that there exists a continuing need for new and improved mail organizer which can be used for organizing mail and assorted papers. In this regard, the present invention substantially fulfills this need.

SUMMARY OF THE INVENTION

In the view of the foregoing disadvantages inherent in the known types of mail organizing devices now present in the prior art, the present invention provides an improved mail organizer. As such, the general purpose of the present invention, which will be described subsequently in greater detail, is to provide a new and improved mail organizer and method which has all the advantages of the prior art and none of the disadvantages.

To attain this, the present invention essentially comprises, in combination, a cabinet having a horizontal rectangular planar bottom wall with a front edge, a rear edge, and opposed side edges extended therebetween, a pair of opposed rectangular planar side walls coupled to and extended upwards from the side edges of the bottom wall, a curved top wall integral with an upper extent of each side wall, and a planar back wall connected between the side walls, the top wall, and the bottom wall to define a hollow compartment. A sequential arrangement of four box-shaped mail bins is provided and disposed within a central extent of the compartment and secured to each other and to the opposing side walls of the cabinet. Each mail bin is used for holding a selected individual's mail. Each mail bin has a rectangular front opening and a hinged and key-lockable door that is positionable over the front opening for preventing access within the associated mail bin.

A first drawer, a second drawer, and a third drawer are included and positioned in a stacked arrangement that fills an upper portion of the compartment above the mail bins. In addition, a fourth drawer and a fifth drawer are positioned in a stacked arrangement that fills a lower portion of the compartment below the mail bins. The first drawer is positioned adjacent to the top wall. The third drawer is positioned adjacent to and above the mail bins. The second drawer is positioned adjacent to and below the first drawer and adjacent to and above the mail bins. The fourth drawer is positioned adjacent to and below the mail bins. Lastly, the fifth drawer is positioned adjacent to and below the fourth drawer and adjacent to and above the bottom wall of the cabinet. The first drawer is used for holding a current day's mail. The second drawer is used for holding monthly bills. The third drawer is used for holding miscellaneous uncategorized mail for up to 30 days. The fourth drawer is used for holding 7 days worth of newspapers and magazines. The fifth drawer is used for holding trash mail and paper trash.

The first drawer has a vertical planar front wall with a curved long upper edge conforming with the curved shape of the top wall and a straight long horizontal lower edge. The second, the third, the fourth, and the fifth drawer each have a vertical planar rectangular front wall with a long horizontal upper edge, a long horizontal lower edge, and a pair of short vertical side edges extended therebetween. Each front wall further has a handle centrally coupled thereto for allowing opening and closing of the associated drawer by hand. A longitudinal slot is formed on the front wall of each drawer with an openable spring-loaded cover positioned over the slot. Each slot is sized to allow deposition of mail and papers within the associated drawer. The fifth drawer has a depth greater than each of the other drawers.

A calendar pad is included and attached to the front wall of the first drawer and formed of a stack of individually removable paper sheets. Each sheet bears a date thereupon. A pad of individually removable adhesive tape strips is included and secured to the front wall of the second drawer. Each strip is capable of being written upon for indicating a due date for a selected piece of mail. Lastly, four rotatable wheels are included and pivotally coupled to and extended downwards from each corner of the bottom wall of the cabinet. The wheels allow the cabinet to be supported upon a recipient surface and readily moved from one location to another.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mail organizer which has all the advantages of the prior art mail organizing devices and none of the disadvantages.

It is another object of the present invention to provide a new and improved mail organizer which may be easily and efficiently manufactured and marketed.

It is a further object of the present invention to provide a new and improved mail organizer which is of durable and reliable construction.

An even further object of the present invention is to provide a new and improved mail organizer which is susceptible of a low cost of manufacture with regard to both materials and labor, and which accordingly is then susceptible of low prices of sale to the consuming public, thereby making such a mail organizer economically available to the buying public.

Still yet another object of the present invention is to provide a new and improved mail organizer which provides in the apparatuses and methods of the prior art some of the advantages thereof, while simultaneously overcoming some of the disadvantages normally associated therewith.

Even still another object of the present invention is to provide a new and improved mail organizer for organizing mail and assorted papers.

Lastly, it is an object of the present invention to provide a new and improved mail organizer comprising a cabinet having a bottom wall, a pair of opposed side walls coupled to and extended upwards from the bottom wall, a curved top wall integral with an upper extent of each side wall, and a back wall connected between the side walls, the top wall, and the bottom wall to define a hollow compartment; a sequential arrangement of mail bins disposed within a central extent of the compartment and secured to the cabinet and with each bin used for holding a selected individual's mail; and a first drawer, a second drawer, and a third drawer positioned in a stacked arrangement that fills an upper portion of the compartment above the mail bins, and a fourth drawer and a fifth drawer positioned in a stacked arrangement that fills a lower portion of the compartment below the mail bins, each drawer further having a slot formed thereon sized to allow deposition of mail and papers within the associated drawer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a fragmentary perspective view of the present invention with a drawer and several of its mail bins opened.

FIG. 3 is a cross-sectional view of the present invention taken along the line 3—3 of FIG. 2.

The same reference numerals refer to the same parts through the various Figures.

DESCRIPTION OF THE PREFERRED EMBODIMENT

Figure 1:
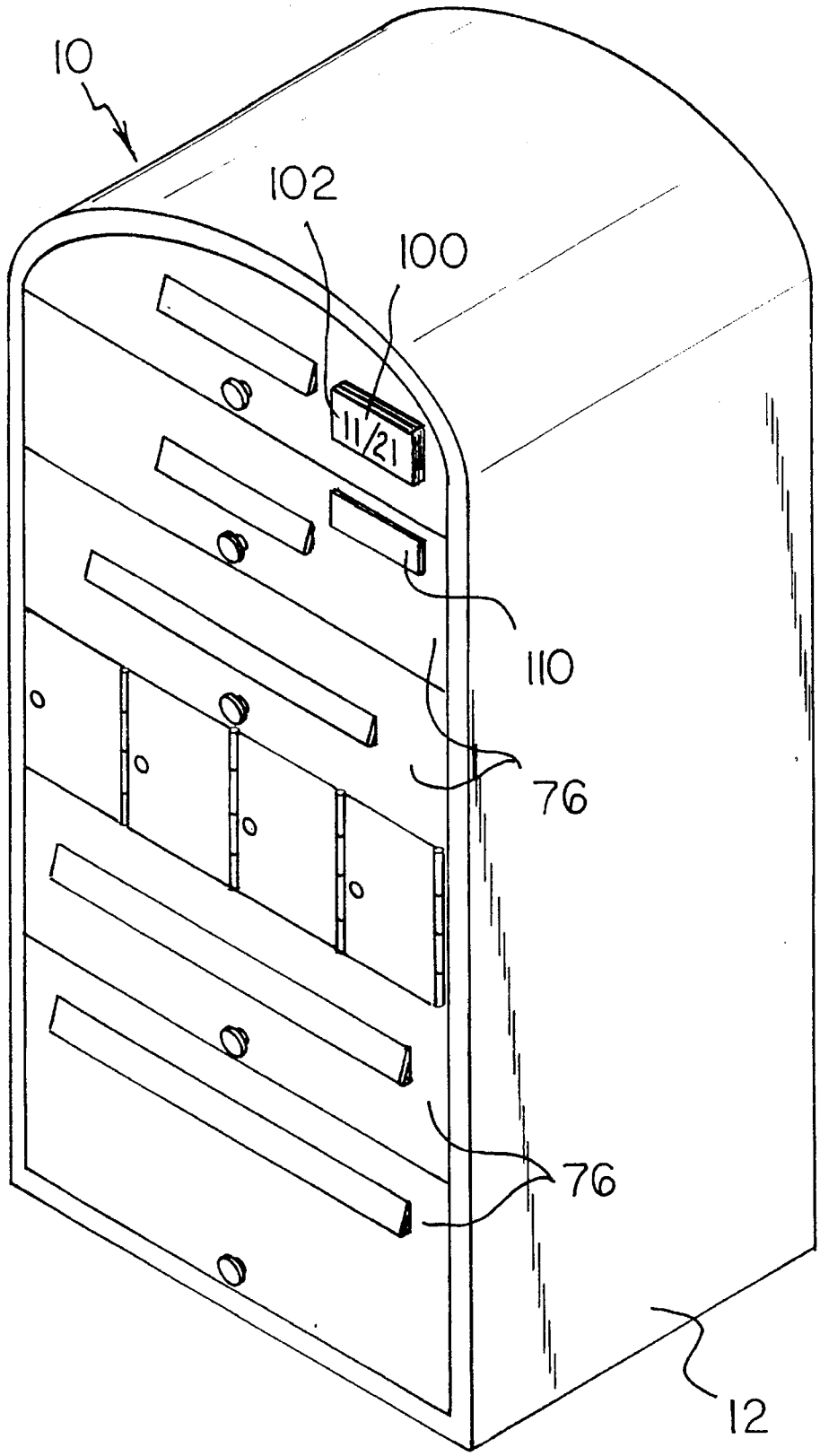
FIG. 1 is a perspective view of the preferred embodiment constructed in accordance with the principles of the present invention.
Figure 4:
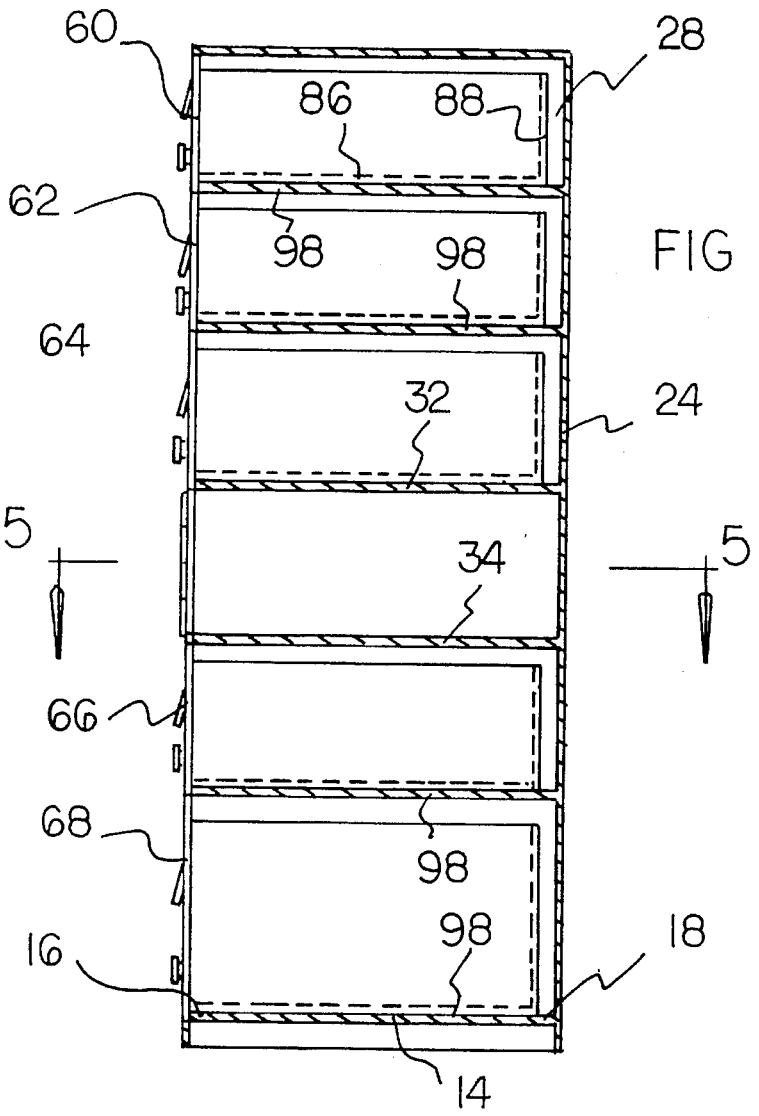
FIG. 4 is a vertical cross-sectional view of the present invention.
Figure 5:
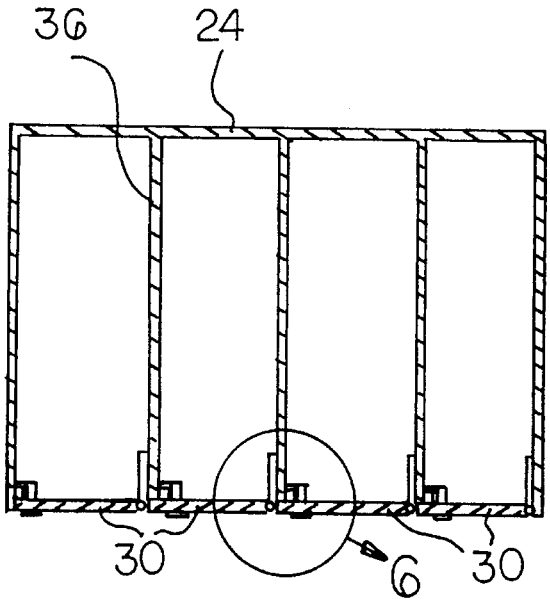
FIG. 5 is a cross-sectional view of the array of mail bins of the present invention taken along the line 5—5 of FIG. 4.
Figure 6:
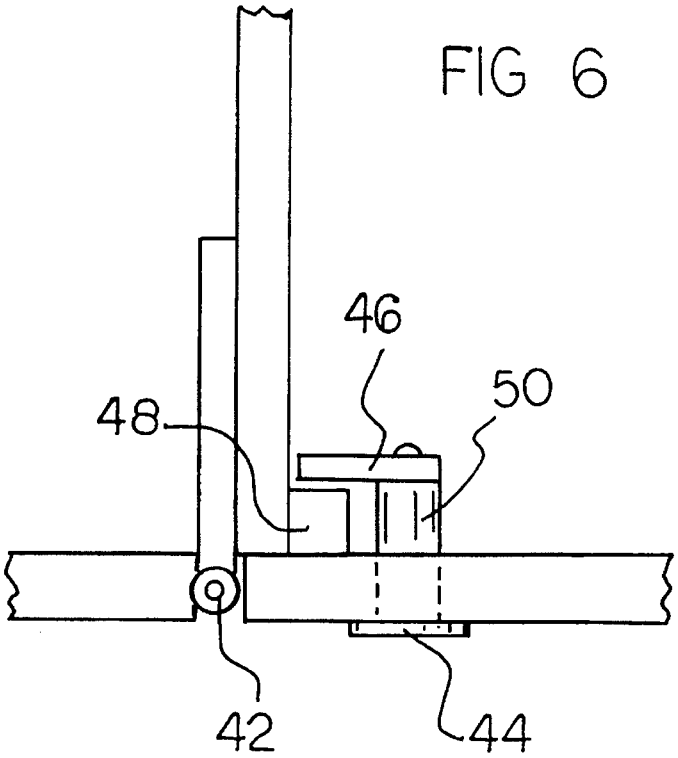
FIG. 6 is an enlarged fragmentary view taken from circle 6 of FIG. 5.
Figure 7:
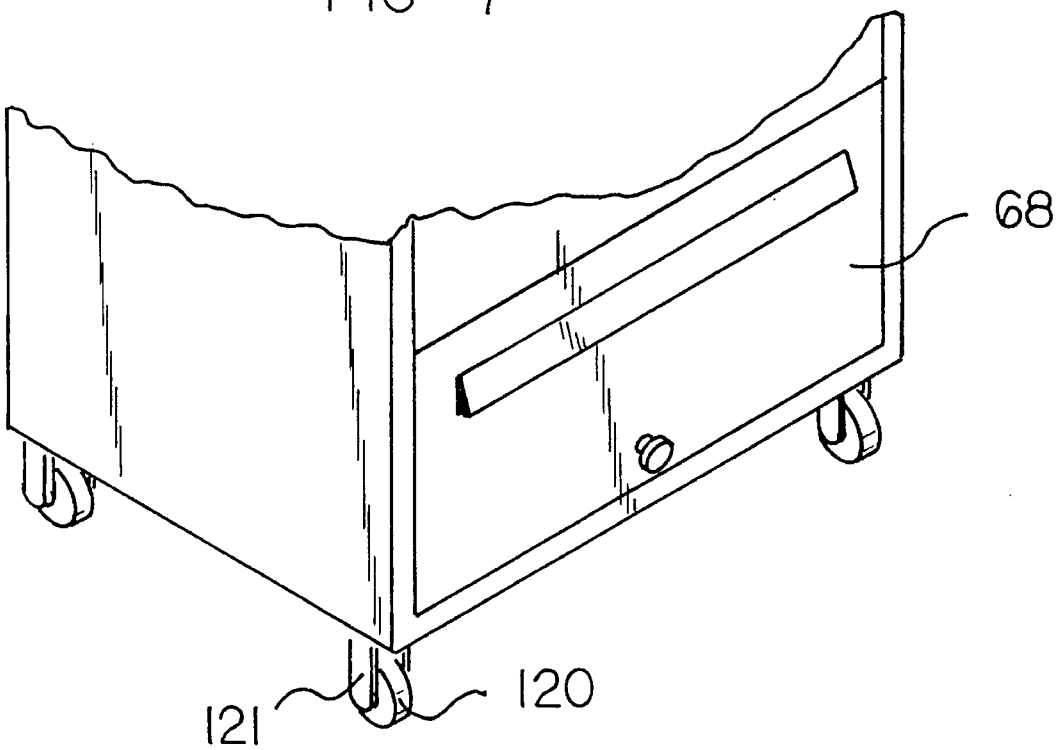
FIG. 7 is a partial perspective view of a lower portion of the present invention.

With reference now to the drawings, and in particular, to FIG. 1 thereof, the preferred embodiment of the new and improved mail organizer embodying the principles and concepts of the present invention and generally designated by the reference number 10 will be described.

The preferred embodiment of the present invention comprises a plurality of components. In their broadest context, such components include a cabinet, mail bins, drawers, calendar pad, tape strip pad, and wheels. Such components are individually configured and correlated with respect to each other to provide a structure that allows mail and assorted papers to be organized for a family of other group of individuals.

Specifically, the present invention includes a cabinet 12. The cabinet has a horizontal, rectangular, and planar bottom wall 14. The bottom wall 14 has a front edge 16, a rear edge 18, and a pair of opposed side edges extended therebetween. A pair of opposed, rectangular and planar side walls 20 are coupled to and extended upwards from the side edges of the bottom wall. In addition, a curved top wall 22 is integral with an upper extent of each side wall 20. The curved top wall precludes papers and miscellaneous items from being haphazardly placed upon the cabinet, thereby precluding the creation of a disorganized and untidy appearance. Lastly, the cabinet includes a planar back wall 24. The back wall 24 is connected between the side walls 20, the top wall 22, and the bottom wall 14 to define a hollow compartment.

Disposed within a central extent of the compartment of the cabinet 12 is a sequential arrangement of four box-shaped mail bins 30. Each mail bin is formed of a connection of the back wall 24 with an upper interior wall 32, a lower interior wall 34, and three spaced vertical dividing walls 36 extended between the interior walls 32, 34 and the back wall 24. Each mail bin is used for holding a selected individual's mail. Each mail bin has a rectangular front opening 38 and a door 40. Each door is secured to the associated mail bin with a hinge 42. Each door is positionable over the associated front opening and lockable thereto with a key-actuated lock 44. Lock 44 has a latch 46 that is engagable with a stop 48 through actuation of a key (not pictured) within a tumbler mechanism 50. When the door is closed and locked, access is prevented to the associated mail bin.

A first drawer 60, a second drawer 62, and a third drawer 64 are positioned in a stacked arrangement and fill an upper portion of the compartment of the cabinet 12 at a location above the mail bins 30. In addition, a fourth drawer 66 and a fifth drawer 68 are positioned in a stacked arrangement and fill a lower portion of the compartment at a location below the mail bins 30. The first drawer is positioned adjacent to the top wall 22 of the cabinet. The third drawer is positioned adjacent to and above the mail bins 30. The second drawer is positioned adjacent to and below the first drawer 60 and adjacent to and above the third drawer. The fourth drawer is positioned adjacent to and below the mail bins. Lastly, the fifth drawer is positioned adjacent to and below the fourth drawer 66 and adjacent to and above the bottom wall 14 of the cabinet. The first drawer is used for holding a current day's mail. The second drawer is used for holding monthly bills. The third drawer is used for holding miscellaneous uncategorized mail for up to 30 days. The fourth drawer is used for holding 7 days worth of newspapers and magazines. Lastly, the fifth drawer is used for holding trash mail and paper trash.

The first drawer has a vertical planar front wall 70 with a curved long upper edge 72 that conforms with the curved shape of the top wall 22 of the cabinet. The front wall of the first drawer also has a straight long horizontal lower edge 74. The second, the third, the fourth, and the fifth drawer each have a vertical planar rectangular front wall 76 with a long horizontal upper edge 78, a long horizontal lower edge 80, and a pair of short vertical side edges 82 extended therebetween. When the drawers are closed, the front walls of the drawers are aligned in a common vertical plane.

The front wall of each drawer further has a handle 84 centrally coupled thereto. The handle on each drawer allows its ready opening and closing by hand. Each drawer also has a floor panel 86, a rear panel 88, and a pair of opposed side panels 90 which in combination with the front wall define a generally box-shaped configuration for holding mail and papers. The front wall of each drawer also has a longitudinal slot 92 formed thereon and an openable cover 94 positioned over the slot. The cover is biased into position with a spring-loaded hinge 96. Each slot is sized to allow deposition of mail and papers within the associated drawer. The cover is pushed inwards to allow access within a drawer. When released, the cover returns to a rest position over the slot. Each drawer is supported by an interior wall 98 or a pair of rails or similar conventional supporting structure.

Attached to the front wall of the first drawer is a calendar pad 100. The calendar pad is formed of a stack of individually removable tear-off paper sheets. Each sheet bears a date 102 thereupon. The calendar pad is used for tracking dates in association with mail deposited or removed from the drawers or bins of the cabinet.

A pad of individually removable adhesive tape strips 110 are secured to the front wall of the second drawer. Each tape strip is capable of being written upon with a pen or a pencil for indicating a due date of a selected piece of mail taken from or deposited in one of the drawers or the mail bins 30. Lastly, four rotatable wheels 120 are pivotally coupled to and extended downwards from each corner of the bottom wall with a bracket 121. The wheels allow the cabinet 12 to be supported upon a recipient surface and readily moved from one location to another as needs dictate.

What has been described is a mail organizer that helps a family to organize loose mail, and miscellaneous papers such as magazines and newspapers. The present invention allows proper organization and storing of mail and miscellaneous documents. The present invention also provides a readily accessible trash drawer for disposal of mail, magazines, and other paper literature. The present invention includes four locking mail bins that allow the confidentiality of an individual family member's mail to be preserved. The present invention is approximately 5 feet 6 inches high. The cabinet, mail bins, and drawers are formed of a rigid material such as metal or plastic. Preferably, the present invention is positioned at a location where it is readily accessed by family members or group as well as a mail carrier.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A mail organizer for organizing mail and associate papers comprising, in combination:

a cabinet having a horizontal rectangular planar bottom wall with a front edge, a rear edge, and opposed side edges extended therebetween, a pair of opposed rectangular planar side walls coupled to and extended upwards from the side edges of the bottom wall, a curved top wall integral with an upper extent of each side wall, and a planar back wall connected between the side walls, the top wall, and the bottom wall to define a hollow compartment;

a sequential arrangement of four box-shaped mail bins disposed within a central extent of the compartment and secured to each other and to the opposing side walls of the cabinet, each mail bin used for holding a selected individual's mail and with each mail bin having a rectangular front opening and a hinged and key-lockable door that is positionable over the front opening for preventing access with the associated mail bin;

a first drawer, a second drawer, and a third drawer positioned in a stacked arrangement that fills an upper portion of the compartment above the mail bins, and a fourth drawer and a fifth drawer positioned in a stacked arrangement that fills a lower portion of the compartment below the mail bins, and with the first drawer positioned adjacent to the top wall, the third drawer positioned adjacent to and above the mail bins, the second drawer positioned adjacent to and below the first drawer and adjacent to and above the third drawer, the fourth drawer positioned adjacent to and below the mail bins, and the fifth drawer positioned adjacent to and below the fourth drawer and adjacent to and above the bottom wall and with first drawer used for holding a current day's mail, the second drawer used for holding monthly bills, the third drawer used for holding miscellaneous uncategorized mail for up to 30 days, the fourth drawer used for holding 7 days worth of newspapers and magazines, and the fifth drawer used for holding trash mail and paper trash, the first drawer having a vertical planar front wall with a curved long upper edge conforming with the curved shape of the top wall and a straight long horizontal lower edge, and the second, the third, the fourth, and the fifth drawer each having a vertical planar rectangular front wall with a long horizontal upper edge, a long horizontal lower edge, and a pair of short vertical side edges extended therebetween, the front wall of each drawer further having a handle centrally coupled thereto for allowing opening and closing of the associated drawer by hand and a longitudinal slot formed thereon with an openable spring-loaded cover positioned over the slot and with each slot sized to allow deposition of mail and papers within the associated drawer, and wherein the fifth drawer has a depth greater than each of the other drawers;

a calendar pad attached to the front wall of the first drawer and formed of a stack of individually removable paper sheets with each sheet bearing a date thereupon;

a pad of individually removable adhesive tape strips secured to the front wall of the second drawer and with each strip capable of being written upon for indicating a due date for a selected piece of mail; and four rotatable wheels pivotally coupled to and extended downwards from each corner of the bottom wall of the cabinet for allowing the cabinet to be supported upon a recipient surface and readily moved from one location to another.

* * * * *